United States Patent [19]

Day et al.

[11] 4,144,814

[45] Mar. 20, 1979

[54] DELAY DETONATOR DEVICE

[75] Inventors: Edward A. Day, Rancho Santa Fe, Calif.; Glenn E. Seay, Los Alamos, N. Mex.; Perry B. Ritter, Encinitas, Calif.

[73] Assignee: Systems, Science and Software, LaJolla, Calif.

[21] Appl. No.: 703,601

[22] Filed: Jul. 8, 1976

[51] Int. Cl.[2] ..... F42B 3/12; F42C 19/12

[52] U.S. Cl. ..... 102/28 R; 89/1 B

[58] Field of Search ..... 102/28; 89/1 C; 149/40

[56] References Cited

U.S. PATENT DOCUMENTS

| | | | |
|---|---|---|---|
| 2,883,931 | 4/1959 | Houck et al. | 89/1 C |
| 3,009,418 | 11/1961 | Zebree | 102/28 |
| 3,062,143 | 11/1962 | Savitt et al. | 102/28 |
| 3,726,730 | 4/1973 | Rose et al. | 149/40 |
| 3,978,791 | 9/1976 | Lemley et al. | 102/28 |

*Primary Examiner*—Verlin R. Pendegrass

*Attorney, Agent, or Firm*—Fitch, Even & Tabin

[57] ABSTRACT

A reliable delay detonator device is disclosed which is thermally and chemically stable and which is also insensitive to mechanical shock and electrostatic charge. The device can be made with differing time delays and can be interconnected with other detonator devices for achieving multiple delay characteristics. A modification of the device is particularly suited to high temperature use. None of the devices contain any primary explosives, the device relying upon pyrotechnic delay materials and secondary explosives.

9 Claims, 4 Drawing Figures

Fig. 1.
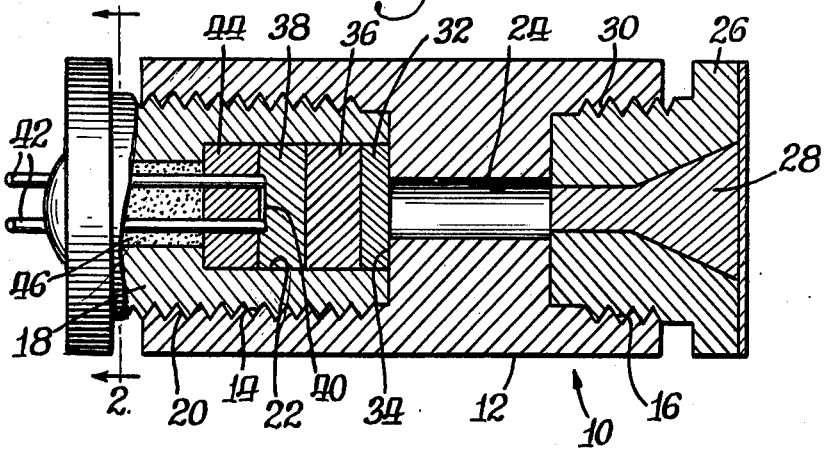
Fig. 2.
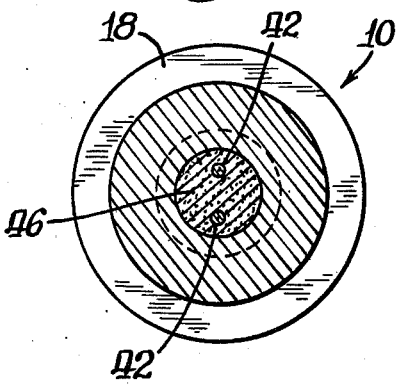
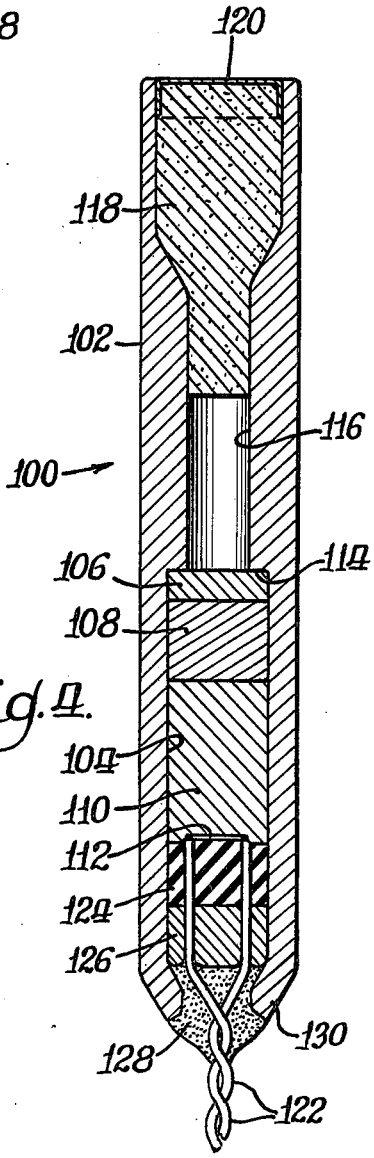
Fig. 4.
Fig. 3.
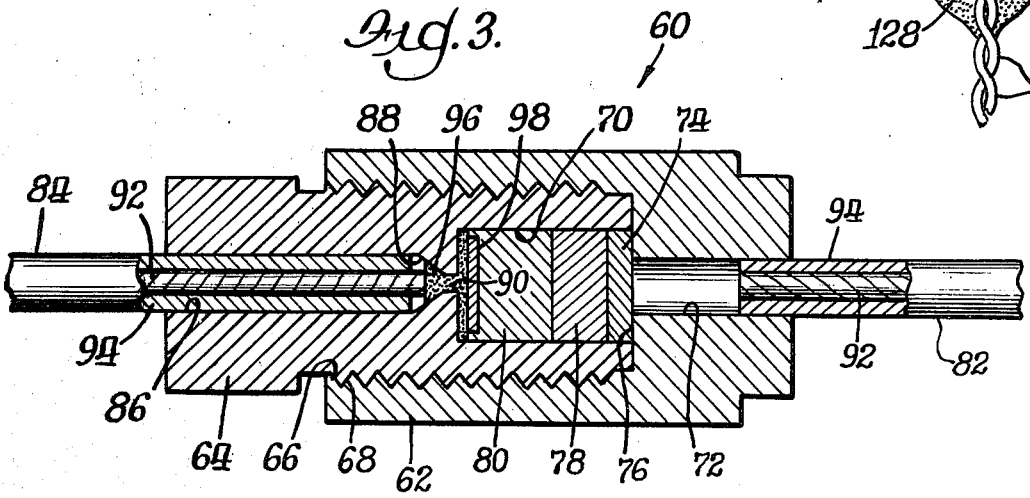

DELAY DETONATOR DEVICE

This invention generally relates to improved delay detonator devices and, more particularly, to delayed detonator devices which contain only pyrotechnic materials and secondary explosives.

There has been a continuing effort in designing a reliable detonator device that contains no primary explosives for military use as well as commercial applications. The absence of primary explosives greatly reduces the hazards that are typically associated with detonators. By incorporating pyrotechnic materials and secondary type explosives in such detonators, they are significantly less vulnerable to the possibility of detonation due to mechanical shock or static electrical discharge. While there has been considerable research and development of an all secondary explosive detonator devices, difficulty has been experienced in designing and building a device that has any significant reliability. One such reliable all secondary explosive nondelay detonator device is disclosed in U.S. Pat. No. 3,978,791, by Lemley, et al., which is assigned to the same assignee as the present invention.

While the Lemley, et al. patent is directed to an instantaneous firing detonator device, the safety considerations that are disclosed therein are also applicable to a detonator device that is fired after a predetermined time delay. Because delay detonators that are currently used incorporate sensitive igniter mixes, they suffer from the same type of problems that are experienced with instantaneously acting detonator devices that utilize primary explosives, i.e., they are relatively sensitive to mechanical shock, heat, static electric discharge and the like.

Accordingly, it is an object of the present invention to provide a detonator device that has an absence of primary explosive which has delay capability and which is reliable in its operation.

Yet another object of the present invention is to provide a delay detonator which is adapted for use in detonation-pyrotechnic delay-detonation delay trains.

Still another object of the present invention is to provide a delay detonator that is reliable in its operation at elevated temperatures, i.e., temperatures approaching 600° F.

Other objects and advantages will become apparent upon reading the following detailed description in conjunction with the attached drawings, in which:

FIG. 1 is a plan view with portions broken away illustrating a delay detonator device embodying the present invention;

FIG. 2 is a cross section taken generally along the line 2—2 in FIG. 1;

FIG. 3 is a plan view with portions broken away of another embodiment of the present invention; and, FIG. 4 is a cross section of yet another embodiment of the present invention.

Turning now to the drawings and particularly FIGS. 1 and 2, one embodiment of the delay detonator device of the present invention, indicated generally at 10, comprises a generally cylindrically shaped body 12 having internal threads 14 and 16 at opposite end portions thereof, with the threads 14 receiving an insert portion 18 with outer threads 20 engaging the threads 14. When the insert portion 18 is fully inserted to the position as shown, the detonator device 10 has an internal chamber 22 which communicates with a first bore 24 that has an internal diameter that is less than the diameter of the chamber 22. A second insert 26 may be positioned at the opposite end of the bore 24 and contain an acceptor charge 28 of secondary explosive for detonating a main charge of explosive. The insert 26 shown has the charge 28 in an outwardly flared conical configuration in line with the bore 24. The insert 26 has outer threads 30 for engaging the inner threads 16, and may be removed in favor of a fuse element which may be positioned within the bore 24 for providing a multiple delay train as will be hereinafter described.

Referring again to the internal chamber 22, an impactor disk 32 is located adjacent the bore 24 abutting against the end of the chamber. The surface against which the disk abuts is in the shape of a flat annular shoulder 34 having a radial width that is defined by the difference in the internal diameters of the chamber and the bore 24. A charge of secondary explosive 36 is positioned adjacent the impactor disk 32 and another charge 38 of a pyrotechnic delay mixture is positioned adjacent the donor secondary explosive charge. A bridge wire 40 that is connected at opposite ends to conductors 42 provides the means for initiating the detonator device and may operate in accordance with the well known technique, initiation by a hot wire. Layers of header insulation 44 and header backing 46 are positioned near the delay mixture 38 and the backing layers have apertures through which the conductors 42 penetrate into the delay mixture charge.

Broadly stated, the operation of the detonator device results in the acceptor charge 28 being detonated when the bridge wire 40 is energized to ignite the delay mixture charge 38 which, due to its slow burning characteristic, undergoes a time delay before it initiates deflagration of the donor secondary explosive charge 36. The deflagration of the donor charge 36 produces a high pressure within the chamber that causes the interior central portion of the impactor disk 32 (coextensive within inside diameter of the bore 24) to be sheared from the disk and be accelerated down the bore with sufficient velocity to detonate the acceptor explosive 28.

The reliability in the operation of the detonator device is partially attributable to the proper confinement of the secondary explosive charge 36 so that complete deflagration occurs. If the secondary explosive charge is not completely deflagrated, the ultimate pressure that is produced in the chamber will vary from device to device with the result that insufficient pressure may not be generated. If the pressure is insufficient, the central portion may be sheared from the impactor disk but may not acquire the necessary travelling speed when it impacts with the secondary explosive and may be insufficient to cause detonation thereof. Thus, the donor explosive must be chosen so that it will be self-sustaining after ignition and undergo complete deflagration so that the requisite pressures are produced.

In keeping with the present invention, the donor secondary explosive charge 36, as well as the acceptor secondary explosive charge 28, are preferably made of RDX, PBXN-5, PETN, HMX or other secondary explosives which will sustain complete deflagration. The preferred secondary explosive is RDX explosive, type B, class C, military standard MIL-R-398C having a particle size of about 100 microns, and pressed to about 12,500 p.s.i. pressure to achieve a density of about 1.65 to about 1.67 and preferably about 1.65 grams/cc. Its chemical composition is 1, 3, 5-trinitro-1, 3, 5-triazacyclohexane and is made by the acetic anhydride process.

The PBXN-5 explosive made in accordance with military standard MIL-E-81111 and having a particle size of 20 microns per military standard RR-S-366 is pressed to a density of about 1.67 grams/cc. PBXN-5 consists of about 4.5% to about 5.5% by weight of the copolymer vinylidene fluoride and hexafluoropropylene, with the remainder being HMX explosive, which is 1, 3, 5, 7-tetranitro-1, 3, 5, 7-tetrazacyclo-octane. While both the RDX and PBXN-5 explosives may be used for the donor explosive, the RDX explosive is preferred, and, the PBXN-5 is preferred for the acceptor secondary explosive charge 28.

In accordance with an important aspect of the present invention, when the RDX explosive is used as the donor explosive charge 36, its complete deflagration is reliably assured when it is tightly confined. Thus, the chamber 22 should be completely filled as shown in FIG. 1. Since the header materials 44 and 46 are solid and do not appreciably relieve any high pressure when the charges within the chamber are activated, it should be appreciated that confinement of the donor explosive will be maintained if the delay mixture 38 burns without any appreciable pressure change. It is important that the delay mixture charge 38 undergo burning without significantly increasing the pressure within the chamber and, accordingly, a non-gassing delay mixture is preferred. In this regard, a pyrotechnic mixture that is non-gassing and has burn speed characteristics that are suitable for the particular application of use have been found quite acceptable. Pyrotechnic delay mixtures can be formulated with differing burn rates so that the ultimate time delay that is experienced can be tailored to various applications. In this regard, delay mixtures that are suitable for the charge 38 are preferably series I through V mixtures made in accordance with military standard MIL-T-23132A (A.S.) dated June 16, 1972. More specifically, one such mixture, designated "W-1" is formulated from 30% tungsten powder having a particle size of from 5 to 10 microns, 56% barium chromate, 9% potassium perchlorate and 5% diatomaceous earth. This delay mixture is pressed to a density of about 20,000 p.s.i. and is a series IV delay mixture having a burn rate within the range of about 28 to about 33 seconds/inch and generally about 32 seconds/inch. Another slow burning delay mixture, designated "W-2" comprises 34% tungsten powder with a particle size of about 2 ½ to 5 microns, 52% barium chromate, 9% potassium perchlorate and 5% diatomaceous earth. This delay mixture is a series III mixture and has a burn rate within the range of about 5 to about 28 seconds/inch and generally about 18 seconds/inch. Still another delay mixture, designated "W-3", is significantly faster than the above described mixtures and comprises about 58% tungsten powder having a particle size of less than 1 micron, 32% barium chromate, 5% potassium perchlorate and 5% diatomaceous earth. This mixture is a series I mixture and has a burn rate of about 0.38 seconds/inch.

Each of these pyrotechnic delay mixtures can be used as the delay mixture charge 38 in the chamber 22 because they burn without appreciably generating gases, i.e., they are nongassing, and therefore do not appreciably increase the pressure within the chamber prior to initiating deflagration of the donor charge 36.

In keeping with the present invention and referring to the impactor disk 32, the pressure that is required to achieve the shearing of the central portion from the impactor disk is a function of the physical characteristics of the material from which the disk is made as well as the physical dimensions and configuration of the disk. With the material composition and physical characteristics that are contemplated for the disk, a pressure approaching 50,000 p.s.i. generated by the deflagration of the donor charge 36 is sufficient to shear the central portion from the disk 32 and propel it through the bore 24 with sufficient velocity to detonate the acceptor secondary explosive 28.

As is fully described in the Lemley, et al. patent, the detonation of the acceptor secondary explosive produced by the impact or shock of the central portion of the impactor disk 32 is a function of the interaction pressure between the explosive and the central portion of the disk. However, pressure is not the only parameter that produces a high order detonation of explosive. Other parameters include the time in which the pressure acts as well as the distance that the pressure wave travels into the explosive and the effect of simultaneous impact of the acceptor explosive 28 and its holder, insert 26. Thus, if the area of impact is quite small, as might occur in the event the central portion disintegrated into a number of fragments, release waves would move in to relieve the high pressure and would thereby shorten the time in which the initial pressure would be applied to the explosive. If the time in which the pressure is applied is of insufficient duration, detonation may not be achieved. Each type of explosive has its own limit of combined pressure and initiation distance that is required to achieve a high order detonation and these limits are determined by the chemical composition and physical properties of the particular explosive that is used.

Turning now to the impactor disk 32, it should be made from a material having the physical characteristics that would enable the central portion thereof to be sheared from the outer annular portion that is supported by the annular shoulder 34 and be accelerated through the bore 24 so that it can attain an impact velocity of at least about 1 millimeter per microsecond. The length of the bore 24 through which the pressure acts on the accelerating central portion is an important parameter in providing the requisite velocity upon impact for causing detonation. A bore length within the range of about 0.160 to about 0.425 inch has been found to be acceptable for devices having an outer diameter of about 0.3 inch, a length of about 1.1 inches. With a pressure of about 50,000 p.s.i. generated within the chamber 22, an impactor disk having a thickness of about 0.050 inch and a ratio of thickness to the diameter of the central portion within the range of about 0.4 to about 0.5 provides reliable operation in that the central portion can be sheared and accelerated as a unitary piece toward and impact squarely the secondary acceptor charge 28 and its holder, insert 26. In this regard, it is also important that the accelerated central portion not only maintain its structure integrity, i.e., it does not disintegrate into small fragments, but that it travel down the bore without tumbling. If the central portion tumbles, it will permit pressure to escape between this moving portion and the bore wall which will result in slower ultimate speed upon impact, depending upon the amount of pressure loss that is experienced. By using a ratio of thickness to diameter within the prescribed range, the tendency for tumbling of the central portion during its travel down the bore is substantially minimized. When stronger materials such as titanium alloys are used for the impactor disk, the central portion may be thicker than the annular portion from which the central portion shears. Such stronger materials may require a reduced thickness to permit shearing of the central portion with the contemplated chamber pressures that are developed.

A preferred material for the impactor disk 32 is either titanium or certain aluminum alloys, such as type 6061-T6 or 5052-H32 aluminum alloys, although other materials having similar mechanical properties to the above may be used. The mechanical, tensile and other physical properties for aluminum alloys are listed in the First Edition of Aluminum Standards and Data, April, 1968 published by the Aluminum Associates, New York, New York. More specifically, with respect to the 6061-T6 aluminum alloy, it has a composition of about 0.4 to 0.8% silicon, about 0.7% iron, about 0.15 to about 0.40% copper, about 0.15% manganese, about 0.8 to about 1.2% magnesium, about 0.04 to about 0.35% chromium, about 0.25% zinc, about 0.15% titanium and the remainder aluminum. The 6061-T6 aluminum alloy has a tensile strength of about 45 ksi, a Brinell hardness number of about 95, an ultimate shearing strength of about 27 ksi, a modulus of elasticity of about $10^7$ p.s.i. and a density of about 169 pounds per cubic foot. When the impactor disk 32 is fabricated from materials that are sustantially similar in their mechanical properties and if the thickness to diameter ratio of the travelling central portion is within the desired range, it moves through the bore in a manner quite similar to a piston within a cylinder. With the prescribed thickness to diameter ratio, tumbling is substantially prevented which thereby limits pressure loss or "blowby" and maximizes the reliability of the device. When the central portion impacts the secondary explosive as a unitary piece, pressure release waves cannot be produced as quickly and the impact pressure is therefore sustained over a longer period of time which contributes to more reliable detonation.

As previously mentioned, the ignition means may be a low voltage hot wire technique as disclosed in the aforementioned Lemley, et al. patent which utilizes a low voltage current through the bridge wire 40 that is sufficient to initiate burning of the pyrotechnic delay mixture charge 38. By using the tungsten powder delay mixture composition W-3, which has a burning time of 0.38 seconds per inch, delays from about 8 to about 30 milliseconds have been experienced. When using the W-1 and W-2 mixtures, delay periods from several milliseconds to several seconds can be achieved. In this regard, the burn rate of the W-1 mixture is nearly half that of the W-2 mixture, i.e., 32 seconds/inch versus 18 seconds/inch.

Turning now to another embodiment of the present invention shown in FIG. 3, it is particularly suited for use in applications where multiple time delays are desired and utilizes a detonation to pyrotechnic delay to detonation action, all of which occur without primary explosive. The delay device, indicated generally at 60, comprises a body 62 and an insert 64 that is threadably coupled to the body by threads 66 and 68. A chamber 70 is provided and a bore 72 is located in the body 62. An impactor disk 74 is positioned adjacent the bore against an annular shelf 76. A donor explosive charge 78 and a delay mixture charge 80 are positioned within the chamber, substantially filling the same. The relative positions and operational considerations of the bore, impactor disk, donor and delay mixture charges shown in FIG. 3 are substantially similar to that previously described with respect to similar components of the detonator device 10. When the delay mixture is initiated and burns until it initiates deflagration of the donor explosive, the requisite high pressures are created to shear out the central portion of the impactor disk and accelerate it down the bore 72. However, it is apparent that an acceptor charge 28 is not present in the embodiment of FIG. 3, it being replaced with a mild detonating fuse (MDF) 82 that is inserted within the bore 72 so that the impact by the central portion will detonate the MDF fuse. Another mild detonating fuse 84 is positioned within a bore 86 of the insert 64. The bore 86 has a conical section 88 which terminates in a smaller aperture 90 that communicates the bore 86 with the chamber 70. The mild detonating fuses 82 and 84 are of conventional construction and may consist of a suitably sheathed cylinder 92, having an outer diameter of about 1/16 inch and containing explosive such as RDX, PETN, HMX or other explosive material which is protected by an outer sleeve 94 of stainless steel or the like having an outside diameter of about $\frac{1}{8}$ inch. The end of the MDF 84 terminating near the conical portion 88 of the bore 86 has the protective sleeve terminating before the sheath of explosive material so that the explosive material comes in contact with a small charge of secondary explosive 96 which extends through the aperture 90 into the chamber 70 near a valve plate 98 which will be discussed in detail. The explosive 96 must be capable of sustaining deflagration through the aperture 90 which may be only about 0.025 in diameter. A PETN explosive or PETN based explosive is preferred, such as PYROCORE explosive as manufactured by the E.I. duPont de Nemours and Company of Wilmington, Delaware. PETN, pentaerythritol tetranitrate, powder is pressed to about 20,000 p.s.i.

During operation, the MDF 84 will ignite the charge 96 which will in turn burn through the aperture 90 into the chamber and ignite the delay mixture charge 80 which, after a suitable delay will initiate deflagration of the donor charge 78 which will result in the shearing of the central portion from the impactor disk 74 and cause it to travel down the bore 72 and detonate the other MDF 82 which can then detonate any explosive charge when properly boosted. An acceptor charge such as the acceptor charge 28 described with respect to the detonator 10 shown in FIG. 1 can be situated at the end of the bore 72 in place of the MDF assembly 82 and detonated as previously described. The overall length of the device 60, excluding the MDF's 82 and 84 is preferably about 1 $\frac{1}{4}$ inches to about $1\frac{1}{2}$ inches with an overall diameter of about $\frac{1}{2}$ inch, although a larger or smaller device is contemplated to be within the scope of the invention.

In accordance with an important aspect of the invention embodied in FIG. 3, the confinement of the donor secondary explosive charge 78 should be maintained, as previously described with respect to the embodiment in FIG. 1. Thus, the delay mixture 80 must be burned without appreciably changing the internal volume or pressure within the chamber and should accordingly be non-gassing as was the case with respect to the delay mixture charge 38 of the detonator 10. To maintain the confinement within the chamber 62, the valve plate 98 is preferably used to close the aperture 90 which communicates the chamber 70 with the bore 86. The valve plate 98 is spaced away from the end of the chamber containing the aperture 90 by the presence of the charge 96. During operation, the burning of the secondary explosive charge 96 begins at the interface with the MDF 92 and burns to the right as shown in FIG. 3, through the aperture 90 and radially outwardly around the valve plate until it initiates burning of the delay mixture 80. The valve plate 98 is sized so that it covers the aperture 90 after the charge 96 has been burned and should be capable of sustaining the high temperatures that result from the burning of the delay mixture 80. Also, it should be capable of sustaining a mild shock which occurs from the MDF 92 and also withstand the high pressures that are generated by the deflagration of the donor charge 78. In this regard, a high nickel alloy valve plate is preferred having a thickness on the order of about 0.025 inch. A high nickel-copper alloy such as MONEL or a high nickel-chromium alloy such as INCONEL may be used. Both of these alloys are made by the International Nickel Corporation. The shape of the valve plate is preferably non-circular in that it preferably has radial outward extensions that define an overall effective diameter that approaches the inside diameter of the chamber. This permits a sufficient area between the inner edge of the plate and the wall of the chamber so that delay charge can be ignited and also have the outward extensions that can meet the wall and maintain the plate centered over the aperture. A square shaped valve plate with diagonal dimensions of about 0.2 inch has been effective to maintain the desired centering and also permit ignition of the delay mixture. The use of the plate, while preferred, is not absolutely critical to operation of the device, but it substantially reduces pressure loss that is experienced through the aperture. The use of the valve plate increases the reliability of the device in that the possibility of malfunction is reduced because of loss of pressure in the chamber. It should also be understood that the delay charge material may be sufficient to close the aperture in the absence of a valve plate, but the reliability of the device is somewhat diminished when this is expected to occur.

Turning now to another embodiment of the invention shown in FIG. 4, a more economical detonating device, indicated generally at 100 is disclosed, which can be more easily made because of the absence of threads and multiple inserts and the like. The detonator device 100 has an integral body 102 which contains a chamber 104, an impactor disk 106, a donor explosive charge 108, a delay mixture charge 110 and a bridge wire 112 at the lower end of the delay charge 110. The impactor disk 106 abuts against an annular shoulder 114 and a bore 116 extends to an acceptor charge 118 that is also held within the body 102. A sealing cap 120 may be provided at the outer exposed end of the acceptor charge. The opposite ends of the bridge wire 112 are connected to conductors 122 which extend through apertures within an insulating header 124 and header packing 126. A sealing material 128 is placed around the conductors 122 where they exit the body. The donor explosive 108 and the delay charge 110 are tightly confined by a swaging operation which can control the confinement pressure within the chamber and the swaging operating bends the outer wall of the body inwardly near the lower end as shown at 130. The operation of the detonator 100 is substantially similar to that described with respect to the detonator 10 shown in FIG. 1.

In keeping with an important aspect of the invention as embodied in FIG. 3, it is particularly suited for use in high temperature applications, i.e., temperatures that may approach or even exceed 600° F. When formulated for use at high temperatures, the donor charge is preferably a mixture of about 33% titanium hydride and about 67% potassium perchlorate which has been found to rapidly generate gas to produce sufficient pressure to shear out and accelerate the central portion of the impactor disk 106. Titanium hydride, as defined for the purposes of this document, has the formula $TiH_x$. For this application the value x can vary from less than 1 to 2. The delay mixture charge 110 may be any of the pyrotechnic mixtures previously described, i.e., those designated as W-1, W-2 or W-3 mixtures, which can be ignited by the hot bridge wire 112. The acceptor charge 118 is preferably TACOT, which is tetranitrodibenzo-1, 3*a*, 4, 6*a* tetraazapentalene, is manufactured by the E. I. duPont de Nemours and Company of Wilmington, Delaware. The thermal stability of these materials permit operating temperatures even exceeding 600° F. for the delay detonator 100.

From the foregoing detailed description, it should be apparent that various embodiments of significantly improved delay detonators have been described which exhibit many desirable attributes and advantages over prior delay detonator devices. The delay detonators embodying the present invention exhibit reliable operation with built in time delay and at least one embodiment can be used at elevated temperatures. The detonator devices avoid the use of either sensitive igniter mixes or primary explosives and are therefore relatively insensitive to heat, mechanical shock and static electricity. The ignition of the delay detonator with a mild detonating fuse enables multiple delays to be used with a single initiation source.

While various embodiments of the invention have been illustrated and described, various modifications thereof will become apparent to those skilled in the art and, acccordingly, the scope of the present invention should be defined only by the appended claims and equivalents thereof.

Various features of the invention are set forth in the following claims.

What is claimed is:

1. A delay detonator device comprising:

a body having an internal chamber, one end of said chamber communicating with an elongated bore, said end defining an annular shoulder generally concentrically positioned relative to said bore;

an impactor disk abutting said annular shoulder in said chamber and overlying said bore;

a donor secondary explosive charge positioned adjacent said impactor disk within said chamber;

a pyrotechnic delay charge having a slow burning characteristic positioned adjacent said donor charge within said chamber, said delay charge being non-gassing and adapted to burn toward and ignite said donor charge, said donor charge being tightly confined within said chamber between said disk and said delay charge, said non-gassing characteristic of said delay charge being effective to provide said predetermined delay without affecting the tight confinement of said donor explosive by either substantially increasing or decreasing the pressure within said chamber during burning of said delay charge;

igniting means for initiating the burning of said delay charge at the end opposite said donor charge, the deflagration of said donor charge being effective to shear the central portion from said impactor disk and accelerate the sheared central portion down the bore as a unitary piece, the thickness of said sheared portion being generally within the range of about 0.4 to about 0.5 of the diameter thereof to substantially prevent tumbling thereof during travel and also prevent substantial escape of explosive gases between said sheared central portion and the wall of said bore; and, an acceptor charge of second explosive located downstream of said bore adapted to be detonated upon impact by said sheared central portion of said impactor disk.

2. A detonator as defined in claim 1 wherein said donor secondary explosive is self-sustaining after initial ignition and develops gaseous pressure of about 50,000 p.s.i. when deflagrated in said chamber.

3. A detonator as defined in claim 1 wherein said donor secondary explosive is RDX explosive, type B, class C, made in accordance with military standard MIL-R-398C.

4. A detonator as defined in claim 1 wherein said delay charge comprises about 34% tungsten powder, having a particle size of about 2½–5 microns, about 52% barium chromate, about 9% potassium perchlorate and about 5% diatomaceous earth, said charge being pressed to a density of about 20,000 p.s.i. and made in accordance with military standard MIL-T-23123A.

5. A detonator as defined in claim 1 wherein said delay charge comprises about 30% tungsten powder, having a particle size of about 5–10 microns, about 56% barium chromate, about 9% potassium perchlorate and about 5% diatomaceous earth, said charge being pressed to a density of about 20,000 p.s.i. and made in accordance with military standard MIL-T-23123A.

6. A detonator as defined in claim 1 wherein said delay charge comprises about 58% tungsten powder, having a particle size of less than 1 micron, about 32% barium chromate, about 5% potassium perchlorate and about 5% diatomaceous earth, said charge being pressed to a density of about 20,000 p.s.i. and made in accordance with military standard MIL-T-23123A.

7. A detonator as defined in claim 1 wherein said igniting means comprises electrically actuated hot wire means located adjacent said delay charge and adapted to cause ignition thereof in response to a low voltage current being applied to said hot wire means.

8. A detonator as defined in claim 7 wherein said igniting means further includes header means located adjacent said delay charge within said chamber and confining said delay and donor charges, said header means having apertures through which electrical conductors pass to the exterior of said body.

9. A detonator as defined in claim 1 wherein said body includes a main body portion and a first insert, said main body portion and first insert being threadably engageable with one another and adapted to be removed so that said donor and delay charges can be inserted in one of said portions, the interconnecting of said portions closing said internal chamber.

* * * * *